US005622321A

United States Patent [19]

Brundiek et al.

[11] Patent Number: 5,622,321

[45] Date of Patent: Apr. 22, 1997

[54] MILL CLASSIFIER

[75] Inventors: Horst Brundiek, Kaarst; Michael Keyssner, Duesseldorf; Reinhard Koschorek, Bochum, all of Germany

[73] Assignee: Loesche GmbH, Dusseldorf, Germany

[21] Appl. No.: 496,885

[22] Filed: Jun. 30, 1995

[30] Foreign Application Priority Data

Jul. 6, 1994 [DE] Germany ..... 44 23 815.0

[51] Int. Cl.[6] ..... B02C 23/22

[52] U.S. Cl. ..... 241/79.1; 241/80; 241/119; 209/139.2

[58] Field of Search ..... 241/79.1, 80, 119, 241/121; 209/139.2

[56] References Cited

U.S. PATENT DOCUMENTS

| | | | |
|---|---|---|---|
| 3,078,651 | 2/1963 | Delfs . | |
| 4,504,018 | 3/1985 | Diggins | 241/79.1 X |
| 4,689,141 | 8/1987 | Folsberg | 241/79.1 X |

FOREIGN PATENT DOCUMENTS

| | | | |
|---|---|---|---|
| 1239624 | 7/1988 | Canada | 241/79.1 |
| 0204412 | 12/1986 | European Pat. Off. . | |
| 0496124 | 7/1992 | European Pat. Off. . | |

OTHER PUBLICATIONS

ZKG International, 46, Jahrgang (1993), Heft 8, Seite 44–450, von H. Brundiek, "Classifier for Roller Grinding Mills", pp. 3–11.

*Primary Examiner*—Mark Rosenbaum
*Attorney, Agent, or Firm*—Keck, Mahin & Cate

[57] ABSTRACT

The invention relates to a mill classifier or sifter, particularly a roller mill classifier, which is suitable as a high-performance classifier for a roller pan mill or a roller mill, e.g. for an air-swept mill. In order to achieve in the case of a particularly simple construction a high flexibility and optimization of the classifying processes as a function of the particular needs, there is a combination of a static distributor formed from several adjustable guide blade rings and a ledge rotor as the dynamic classifier. In order to achieve a multiple classifying and in particular a reduction of the coarse material fraction prior to dynamic classifying, in the vicinity of the static distributor is provided a deflecting device in an area of the classifier cover, through which the disadvantageous effects of a 90° deflection are largely avoided.

12 Claims, 3 Drawing Sheets

MILL CLASSIFIER

FIELD OF INVENTION

The invention relates to a mill classifier, sifter or separator and in particular a roller mill classifier having a static classifier and a dynamic classifier and an annular classifying zone formed between these two classifiers, in which the static classifier is constituted by a radially outwardly positioned distributor having guide blades and the dynamic classifier is constituted by a ledge rotor.

BACKGROUND OF THE INVENTION

Roller mill classifiers, which are integrated into a roller pan mill or a roller mill, e.g. in an air-swept mill or can alternatively be mounted thereon, can be constructed as static or dynamic classifiers.

Combinations of a static and a dynamic classifier are also known, which can then be referred to as a high-performance classifier.

A high-performance classifier for a roller mill is known under the name louvre centrifugal classifier. As the dynamic classifier is provided a centrifugal or ledge rotor classifier surrounded by concentric, interengaged cones of different diameters, accompanied by the formation of a classifying zone. A first classifying or sifting action is brought about by a coaxial whirling flow of the fluid passing out of the blade ring on the circumference of the grinding disk and this brings about a first coarse material separation in a marginal zone. An advantageous second classifying or sifting action is achieved by the louvre cones, in that the upwardly flowing fluid-grinding material mixture is exposed to flow deflections with an upward and downward flow and subsequently a radial flow, so that a second coarse material fraction is separated. This is followed by a sifting on the concentric, interengaged louvre cones, which function in the same way as a static centrifugal classifier and remove a third coarse material fraction. A further classifying action takes place during the downward movement of the grinding material-fluid flow, so that a considerable proportion of the coarse material is removed before the dynamic classification process is performed in the ledge rotor.

A further high-performance classifier is described in ZKG, vol. 46, 1993, No. 8, pp 444 to 450, FIG. 7. This classifier has a cylindrical ledge rotor and a concentrically arranged guide blade ring. A very effective tangential flow is to be produced between the static distributor and the ledge rotor, so that the coarse particles do not reach the rotor. The disadvantages are an increased pressure loss and increasing wear to the guide blades, particularly in the case of high particle concentrations.

However, as opposed to this, louvre centrifugal classifiers in operation have a relatively low wear and also a low pressure loss. However, it is disadvantageous that a rigid construction of the louvre is prejudical to an optimization of the process parameters through the static distributor and that an adaption and optimization is only possible in the field of dynamic classifying, e.g. with the aid of the rotor speed.

SUMMARY OF THE INVENTION

The object of the invention is to provide a high-performance mill classifier, particularly a roller mill classifier, which in the case of a particularly simple construction permits an extremely high flexibility and optimization of the classifying process According to the invention this object is achieved by a mill classifier, which has the advantages of a high-performance louvre classifier and which significantly improves its efficiency by surprisingly simple measures.

According to the invention the dynamic classifier is constituted by a ledge rotor or basket classifier and the static distributor is constituted by several circular guide blade rings, at least one lower and one upper guide blade ring, which are concentric to the dynamic classifier and are accompanied by the formation of a circular classifying zone. In order to avoid an abrupt, right-angled deflection of a fluid-grinding material flow conveyed upwards on the mill casing against a flat classifier cover or top, which would lead to a deceleration of the flow and to a enrichment with particles in the vicinity of the cover or top, according to the invention in an area of the classifier cover adjacent to the upper guide blade ring is provided a deflecting device, which ensures a gentle, directed deflection of the fluid-grinding material flow and brings about a downward flow or movement in the classifying zone. The deflection takes place at an angle of greater than 90° to approximately 180° and as a result of the clearly defined construction of the deflecting device with the provision of several guide blade rings there is an acceleration of the particle flow and a tangential flow velocity increase. This is advantageous, because it makes it possible to reduce the separating grain boundary of the classifier. It is particularly advantageous to adjust the guide blade rings, which in particular have identical dimensions and are axially superimposed, in such a way that the flow cross-section of a guide blade ring is closed partly or over the entire circumference. In particular as a result of a tangential setting of the vertical guide blade rings it is possible to block the flow cross-section. In that e.g. the lower guide blade ring is completely closed, the radial velocity in the upper guide blade ring can be correspondingly increased, so that modified classifying effects and separation boundaries are obtained.

The provision of a static distributor constituted by several superimposed guide blade rings therefore allows a modification to the separation boundary over the height of the static classifier. This possibility can inter alia be utilized in order to set in the vicinity of the upper guide blade ring a coarser separation boundary than in the area of the lower guide blade ring, which brings about a subsequent classification of the coarse material. Whilst taking account of the classifying effect due to the whirling flow of the fluid passing out of the blade ring on the circumference of the grinding pan, as a result of the tendency to expand coarse material is hurled by centrifugal force against the casing wall of the mill and the classifier and then drops down by gravity in a flow-calmed marginal zone. Thus, a first coarse material fraction is separated from the classifying material before it passes into the classifier. Together with the deflection classification in the vicinity of the deflecting device and on the several guide blade rings, the fluid-grinding material flow is already freed from a considerable coarse material percentage before the actual dynamic classifying process is performed on the ledge rotor or centrifugal classifier. This rotary rod basket increases the tangential velocity of the fluid-particle mixture, so that the centrifugal forces produced are essentially determined by the rotor speed.

In an appropriate construction the superimposed, plurality of guide blade rings have aligned fixing spindles, which are fixed to the classifier cover in the vicinity of the deflecting device. With the aid of adjusting levers and/or control rings the guide blades can be adjusted individually or simultaneously with respect to their radial orientation.

According to a further development the adjustment possibility for the guide blade rings is not only directed at the tangential orientation for partial or complete blocking of the flow cross-section of a guide blade ring, but also includes a horizontal or radial adjustment of the guide blade rings for modifying the spacing between said static classifying system or distributor and the dynamic classifier. This makes it possible to influence in planned manner the particle distribution of the finished product.

According to the invention, in a particularly simple construction a marginal area of the classifier cover is constructed as a deflecting device and is provided with an all-round curvature having clearly defined inclination angles. Appropriately the curvature is in cross-section concave, semicircular or in the form of an isosceles trapezoid. The inclination angles are an external angle of attack and an internal deflection angle, which in a preferred central arrangement of the fixing spindles of the guide blade rings are made identical. In this way there is a gentle deflection of the grinding material-fluid flow, where no abrupt deceleration occurs and an accumulation of particles is largely avoided.

A significant classifying effect is achieved in the classifying zone by a drop flow action in the downward flow, where gravity can come into effect. Great significance is attached to the construction of the deflecting device or the curvature in the marginal classifier cover above the classifier rotor. Preferably the curvature has a height which is roughly half that of a guide blade ring, the guide blade rings being positioned above the classifier rotor.

Appropriately when several guide blade rings are provided, the upper guide blade ring is fixed with a hollow shaft and the guide blade rings below it with hollow or solid shafts, which are guided in the upper hollow shaft, to the classifier cover, preferably in the centre of the curvature of the deflecting device.

According to a further development of the invention below the guide blade rings is located a conically tapering partition, which in the vicinity of the ledge rotor defines the classifying zone and terminates in an oversize material discharge in the centre of the grinding rolls. With this partition or the oversize material discharge it is ensured that the coarse particles dropping back counter to a rising fluid-grinding material flow do not lead to a greater pressure loss in the mill and classifier. In addition, a disturbing pressure loss is avoided in that the roller mill classifier has an overall height which leads to a reduced flow rate. This improves the effectiveness of classifying or sifting and simultaneously reduces wear.

The effectiveness of the guide blade ring is further increased in the invention in that there is a deflection of the flow by 120° and possibly even up to 180°, which represents a further increase in effectiveness. As a result of this deflection in addition to the kinetic energy, resulting from an upward movement in a downward movement, use is also made of the gravity acceleration "g" during the downward flow of particles, which gives said particles a further, increased velocity component.

The static preclassifying in the static guide apparatus performed in the invention results not only from the channel effect of the guide blade ring and also not solely through the increase in the velocity component of the particles by the deflection by more than 120°, but instead there is also a particle velocity increase due to the gravity acceleration acting during the downward flow. Such a static guide apparatus constructed according to the invention leads to the formation of a "vortex sink" in the annular space between the guide blade ring as the static classifying apparatus and the ledge rotor as the dynamic classifying apparatus. In this vortex sink, which can also be referred to as a cyclone flow, coarse particles are hurled out beyond the known extent and are consequently kept away from the ledge rotor. Thus, as the second classifying stage to the ledge rotor is supplied a particle mixture, which has already been freed from a very high proportion of the coarse grains. Therefore, the classifying quality of the ledge rotor is significantly improved by the smaller coarse grain percentage.

Thus, a combination effect is obtained, which during the downward flow also utilizes the accelerative forces due to the gravitational force acting on the particles.

DESCRIPTION OF THE PREFERRED EMBODIMENT

The invention is explained in greater detail hereinafter relative to the drawings, wherein show:

FIG. 1 A vertical section in a diagrammatic representation through a roller mill classifier according to the invention.

FIG. 2 A part sectional view through a static guide apparatus used in the invention with a coaxial arrangement of the shafts of a unit of superimposed guide blade rings.

Figure 1:
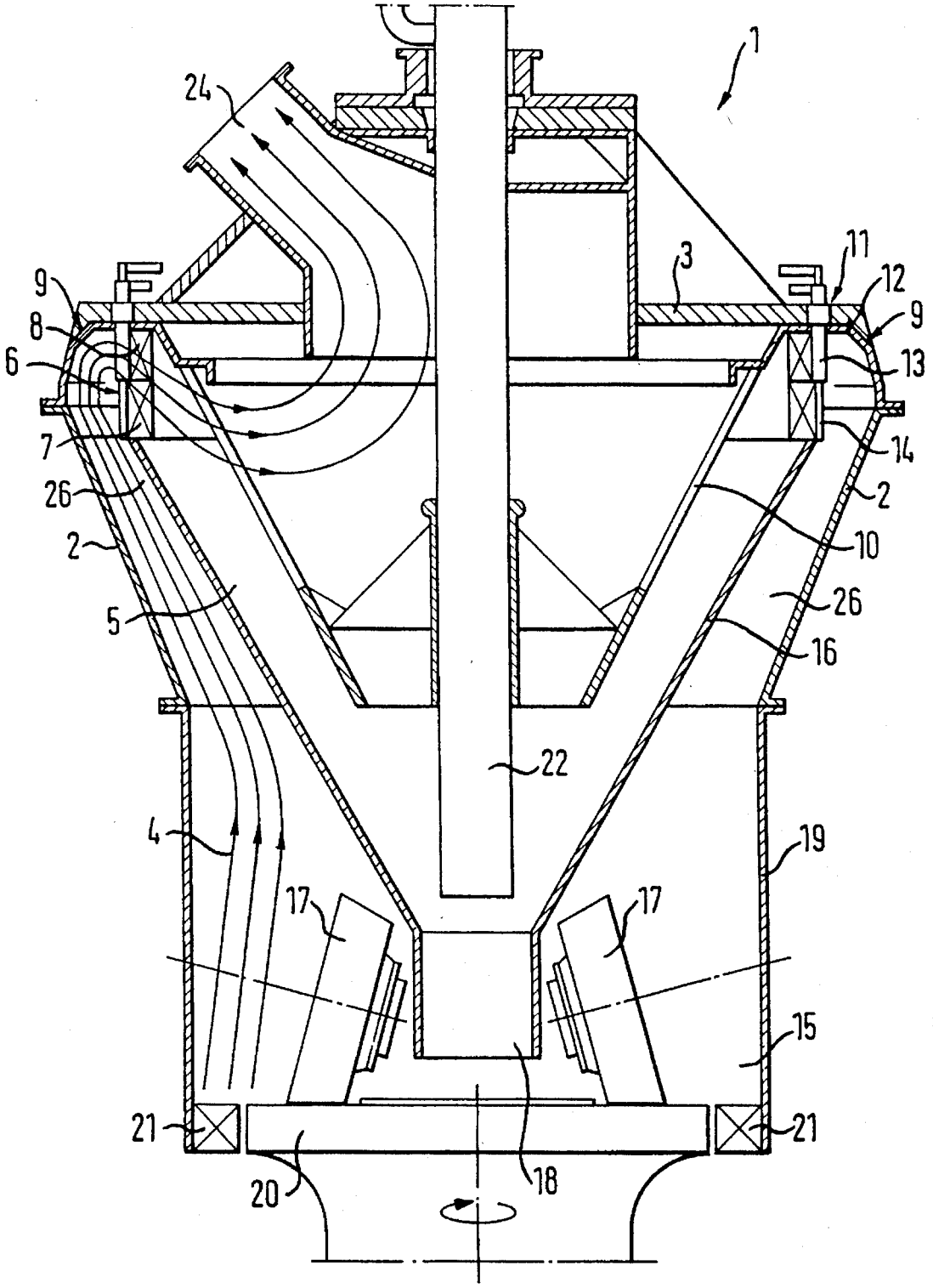

As shown in FIG. 1 the roller mill classifier 1 is mounted on a roller mill, whereof, apart from two grinding rolls 17, a rotary grinding pan 20 and a blade ring 21 surrounding the pan 20, is shown in detail a mill casing 19.

The roller mill classifier 1 has a conically constructed classifier casing 2 and a classifier cover 3, in the vicinity of which is positioned the fine material discharge opening 24. The charge to be ground is supplied to the grinding pan 20 by means of an axially positioned drop tube 22. A conical oversize material discharge opening 18 extends into the vicinity of the grinding rolls 17 and passes into a partition 16, which extends to the guide blade rings 7, 8 of a static distributor 6. The partition 16 and a ledge rotor 10 form a circular classifying zone 5, which the fluid-grinding material flow 4 (only shown in the left-hand area) reaches following a gentle deflection in the vicinity of a deflecting device 9. Prior to the dynamic classifying with the aid of the ledge rotor 10 or a centrifugal classifier, the fluid-grinding material flow 4 is exposed to gravity action in a downward flow. The fluidgrinding material flow 4 to be classified in a whirling flow rising from the blade ring 21, which rises in the vicinity of the inner wall of the mill casing 19 or the classifier casing 2, is guided in an intermediate area 26, which tapers conically upwards and is formed by the partition 16 and the classifier casing 2 up to the deflecting device 9 in the vicinity of the classifier cover 3.

In the represented embodiment the deflecting device 9 is constructed as a curvature 12 in a marginal area of the classifier cover 3 and a static distributor 6. In cross-section the curvature constitutes an isosceles trapezoid, whose base is open downwards to the classifying zone 5 and intermediate area 26. In the vicinity of the deflecting device 9 is fixed the static distributor 6, which comprises a lower guide blade ring 7 and an upper guide blade ring 8 positioned axially above the latter so that a functional cooperation of the guide blade rings 7, 8 and the deflecting device 9 is ensured. The curvature 12 of the deflecting device 9 is located above the classifier rotor 10 and has clearly defined inclination angles, in order to largely prevent an accumulation of particles of the fluid-grinding material flow 4. In this embodiment the inclination angles, namely an outer marginal attack angle and an inner deflection angle, are identical. In a curved bottom-like construction the attack angle and the deflection angle are approximately 45° relative to the horizontal. In a central arrangement the guide blades of the upper guide blade ring 8 are fixed by means of hollow shafts 13 and below the same in a substantially identical construction, the guide blades of the lower guide blade ring 7 are fixed by means of solid shafts 14, which are guided in the upper hollow shaft 13.

In this embodiment there is a different setting of the guide blades or guide blade rings 7, 8 in order to expose a fluid-grinding material flow, which in the vicinity of the deflecting device 9 passes into the classifying zone 5 through an at least 90° and max 180° deflection, following a downward flow, to a radial flow of the classifier rotor 10. The individual angular settings of the two superimposed guide blade rings 7, 8 are advantageous allowing a multiplicity of setting variants. As a result of the adjustment variants for the guide blade rings the supplied fluid-grinding material flows can be forced into different deflection paths and can consquently be exposed to different centrifugal forces optimized by the settings. It is particularly advantageous to pre-separate coarse grain fractions by a classification of the whirling flow and in the vicinity of the two guide blade rings 7, 8 of the static distributor 6, so that the classifying material supplied to the dynamic ledge rotor 10 is reduced. It is possible to allow or set a variable percentage of coarse particles in the fine material. Another advantage is the particularly small wear, which is attributed to a relatively low flow rate of the especially effective classifier.

Figure 5:
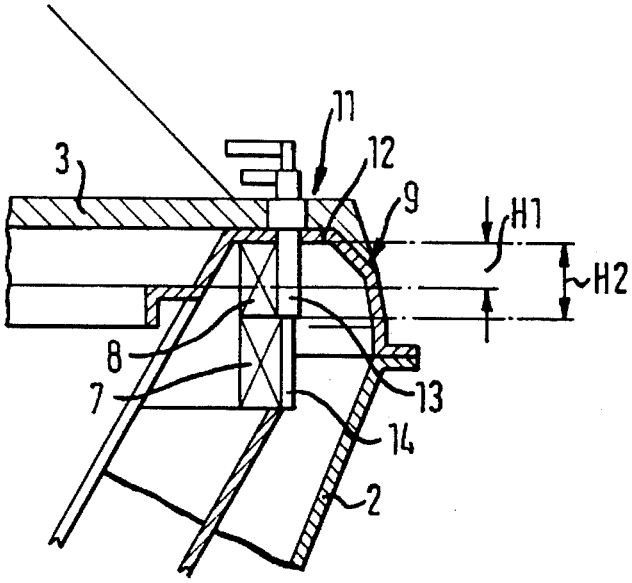
FIG. 5 is an enlargement of a detail of FIG. 1.

FIG. 5 is an enlarged detail of part of FIG. 1, which shows the deflecting device 9 having a curvature in the form of an isosceles trapezoid. The height of the curvature is marked as H1 and the height of the upper guide blade ring 8 is marked as height H2. The height (H1) of the curvature corresponds to approximately half the height (H2) of the upper guide blade ring 8.

Figure 3:
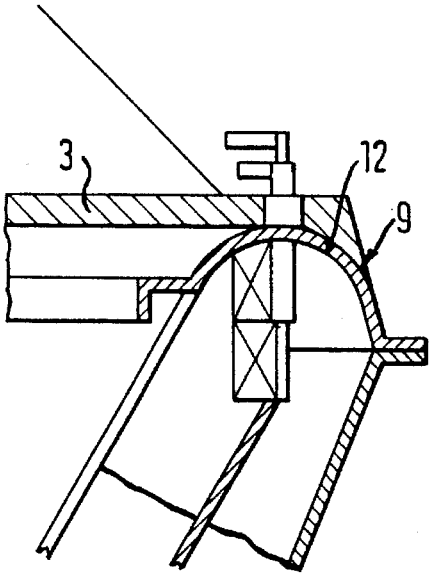
FIG. 3 illustrates a sectional view through a deflecting device having a concave curvature for use with a roller mill classifier according to the invention.
Figure 4:
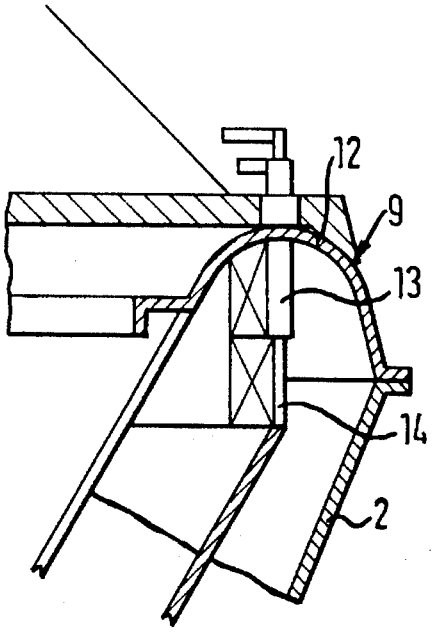
FIG. 4 is a cross-sectional view of a deflecting device similar to that of FIG. 3, but having a semicircular cross-section.

FIG. 3 shows a deflecting device 9 having a concave curvature 12. FIG. 4 shows a deflecting device 9, similar to that of FIG. 3, in which curvature 12 is semicircular in cross-section.

Figure 2:
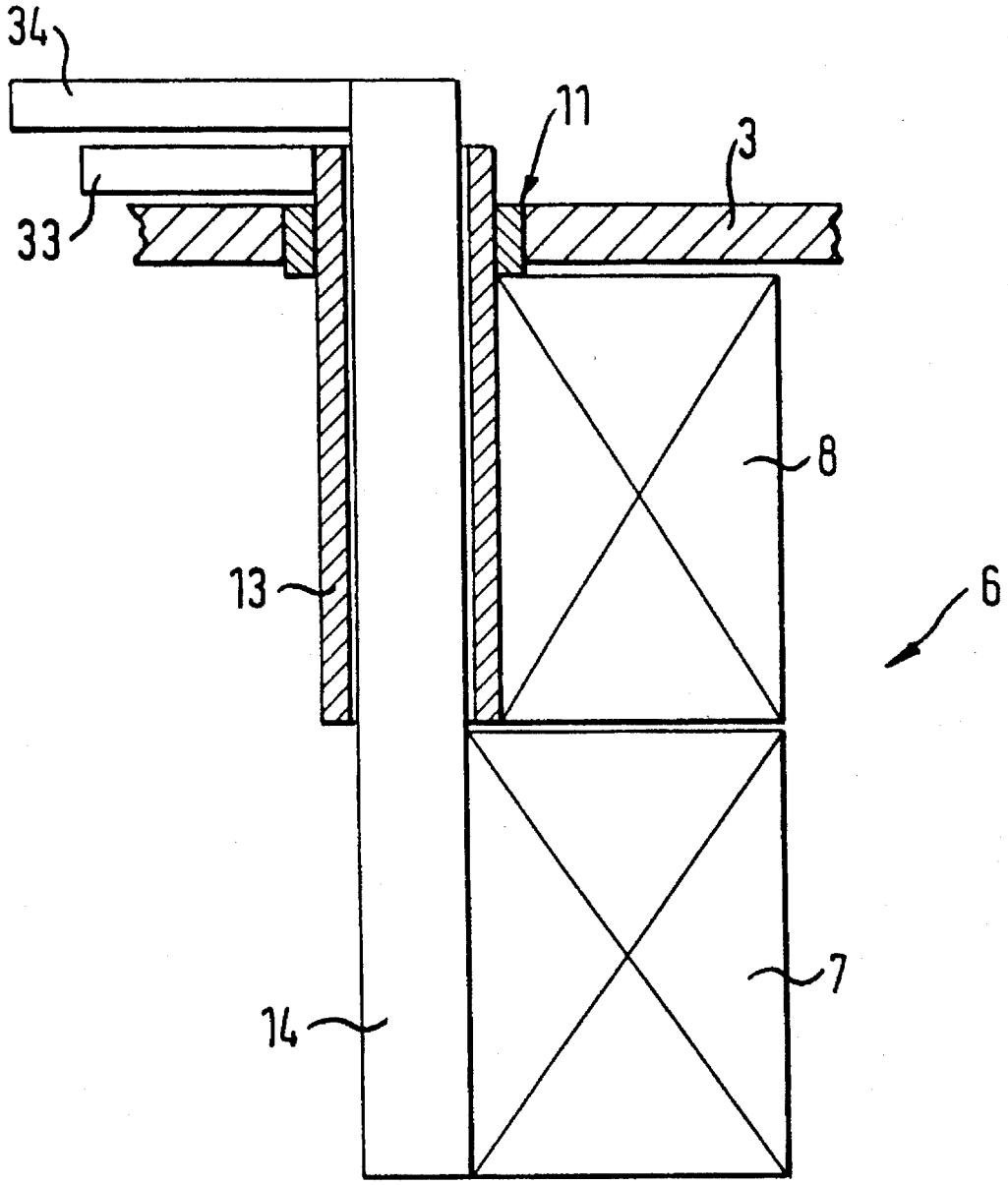

The part sectional representation of FIG. 2 shows a unit of the static guide apparatus, which in the embodiment has an upper guide blade 8 and a lower guide blade 7. The adjustability of these guide blades 7, 8 is performed from outside, i.e. above the classifier cover 3 and for this purpose there is a shaft mounting support 11 in said cover. The upper guide blade 8 is located on a rotary hollow shaft 13, which is fixed outside the classifier cover 3 with an adjusting device 22, which is in particular constructed as a handle and can be secured.

The lower guide blade 7 secured in rotary rigid manner to the shaft 14, can be adjusted to the desired angular setting by said shaft 14, which projects outwards through the hollow shaft 13, and the adjusting device 34, particularly a handle.

In this case easy handling of the guide blade rings from the outside is possible and flow-influencing apparatus parts are reduced.

The guide blades 7, 8 are superimposed and not displaced against one another in the circumferential direction, so that no separating ring is required between the two guide blades. Even in the case of a different angular position of the guide blades, there would only be minimum, undesired "false flows".

What is claimed is:

1. A roller mill classifier, comprising a static classifier, a dynamic classifier, and an annular classifying zone formed between said two classifiers and a deflecting device through which a fluid-grinding material flow rises and is directed through an angle greater than 120° to form a downward flow, the static classifier comprising a radially outwardly positioned guide apparatus with at least one lower guide blade ring and an upper guide blade ring, the dynamic classifier comprising a ledge rotor, wherein the lower guide blade ring and the upper guide blade ring comprise shafts arranged coaxially with one another, and wherein the deflecting device is disposed above the ledge rotor in an area adjacent to the upper guide blade ring, wherein the deflected fluid-grinding material flow forms the downward flow by action of gravity wherein the guide blade rings adjustable independently of one another and wherein a radial or tangential adjustment can be carried out individually or simultaneously for guide blades of a guide blade ring.

2. Mill classifier according to claim 1, wherein the guide blade rings are arranged in axially superimposed and adjustable manner and are fixed with a roughly vertically oriented fixing spindle in a vicinity of the deflecting device, which is located on a classifier cover.

3. Mill classifier according to claim 2, wherein the deflecting device is constructed in a marginal area of the classifier cover with a curvature having a clearly defined inclination and with a clearly defined attack angle and deflection angle and wherein a guide blade rings are arranged in the centre of curvature of the classifier cover.

4. Mill classifier according to claim 3, wherein the curvature is in cross-section concave, semicircular or in a form of an isosceles trapezoid with a downwardly directed opening.

5. Mill classifier according to claim 4, wherein a height of the curvature corresponds to roughly half a height of the upper guide blade ring.

6. Mill classifier according to claim 2, wherein the guide blade rings are adjustable independently of one another or jointly and wherein a radial or tangential adjustment can be carried out individually or simultaneously for all the guide blades of a guide blade ring.

7. Mill classifier according to claim 1, wherein for adjusting the guide blade rings adjusting levers are provided, which are in each case connected to a hollow shaft of the guide blades of the upper guide blade ring and to a solid shaft of guide blades of the lower guide blade ring, the solid shaft being guided in the hollow shaft.

8. Mill classifier according to claim 1, wherein below the guide blade rings is provided a partition tapering conically in a direction of a grinding zone and which in a vicinity of a ledge rotor bounds the classifying zone and terminates in an oversize material discharge opening in a vicinity of grinding rolls of the roller mill.

9. Mill classifier according to claim 8, wherein the partition and the classifier and mill casing form an annular zone, which tapers in a direction of a rising fluid-grinding material flow.

10. Mill classifier according to claim 8, wherein a central drop tube is provided for grinding material charging which extends to close to the oversize material discharge opening.

11. A roller mill classifier, comprising a static classifier, a dynamic classifier, an annular classifying zone formed between said classifiers, and a deflecting device through which a fluid-grinding material flow rises and is directed through an angle greater than 120° to form a downward flow, the static classifier comprising a radially outwardly positioned guide apparatus with at least one lower guide blade ring and an upper guide blade ring, the dynamic classifier comprising a ledge rotor, the upper and lower guide blade rings having shafts arranged coaxially to one another, and wherein the deflecting device is disposed above the ledge rotor in an area adjacent to the upper guide blade ring wherein the deflected fluid-grinding material flow forms the downward flow by action of gravity;

wherein the upper and lower guide blade rings are arranged in axially superimposed and independently adjustable manner and are fixed with a substantially vertically oriented fixing spindle in a vicinity of the deflecting device which is located on a classifier cover; and wherein the deflecting device is constructed in a marginal area of the classifier cover with a curvature having a clearly defined inclination and with a clearly defined attack angle and deflection angle and wherein the guide blade rings are arranged in a centre of curvature of the classifier cover.

12. A roller mill classifier, comprising a static classifier, a dynamic classifier, and a deflecting device through which a fluid-grinding material flow rises and is directed through an angle greater than 120° to form a downward flow and an annular classifying zone formed between said classifiers, the static classifier comprising a radially outwardly positioned guide apparatus with at least one lower guide blade ring and an upper guide blade ring, the dynamic classifier comprising a ledge rotor, the upper and lower guide blade rings having shafts arranged coaxially with one another, and wherein the deflecting device is disposed above the ledge rotor in an area adjacent to the upper guide blade ring wherein the deflected fluid-grinding material flow forms the downward flow by action of gravity;

wherein the guide blade rings are arranged in axially superimposed and independently adjustable manner and are fixed with a substantially vertically oriented fixing spindle in a vicinity of the deflecting device which is located on a classifier cover;

wherein the deflecting device is constructed in a marginal area of the classifier cover with a curvature having a clearly defined inclination and with a clearly defined attack angle and deflection angle and wherein the guide blade rings are arranged in a centre of curvature of the classifier cover;

wherein the curvature is in cross-section concave, semicircular or shaped as an isosceles trapezoid with a downwardly directed opening; and wherein the height of the curvature corresponds to substantially half the height of the upper guide blade ring.

* * * * *